US007520314B2

(12) United States Patent
Hwang et al.

(10) Patent No.: US 7,520,314 B2
(45) Date of Patent: Apr. 21, 2009

(54) HEAT DISSIPATION APPARATUS

(75) Inventors: Ching-Bai Hwang, Tu-Cheng (TW); Jin-Gong Meng, Shenzhen (CN)

(73) Assignees: Furui Precise Component (Kunshan) Co., Ltd., KunShan, Jiangsu Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 108 days.

(21) Appl. No.: 11/309,252

(22) Filed: Jul. 20, 2006

(65) Prior Publication Data

US 2008/0017358 A1 Jan. 24, 2008

(51) Int. Cl.
*H05K 7/20* (2006.01)

(52) U.S. Cl. ..... 165/80.3; 165/122; 361/697

(58) Field of Classification Search ..... 165/80.3, 165/122, 185; 361/697
See application file for complete search history.

(56) References Cited

U.S. PATENT DOCUMENTS 5,583,746 A * 12/1996 Wang ..... 361/697
6,125,920 A * 10/2000 Herbert ..... 165/80.3
6,132,171 A * 10/2000 Fujinaka et al. ..... 415/208.5
6,170,563 B1 1/2001 Hsieh
6,348,748 B1 * 2/2002 Yamamoto ..... 310/62
6,373,700 B1 * 4/2002 Wang ..... 361/698
6,421,237 B1 * 7/2002 Kim ..... 361/696
6,439,299 B1 * 8/2002 Miyahara et al. ..... 165/121
6,796,768 B2 * 9/2004 Fujinaka et al. ..... 415/208.5
6,867,971 B2 * 3/2005 Lai ..... 361/697
6,873,069 B1 * 3/2005 Odagiri et al. ..... 310/64
6,892,800 B2 * 5/2005 Mok ..... 165/104.33
7,071,587 B2 * 7/2006 Lopatinsky et al. ..... 310/64
2002/0172008 A1 * 11/2002 Michael ..... 361/697
2004/0245866 A1 * 12/2004 Lopatinsky et al. ..... 310/64

FOREIGN PATENT DOCUMENTS

TW M277248 10/2005
TW M283495 12/2005

* cited by examiner

*Primary Examiner*—Allen J Flanigan
(74) *Attorney, Agent, or Firm*—Frank R. Niranjan

(57) ABSTRACT

A heat dissipation apparatus (10) for dissipating heat from a heat-generating electronic component includes a fin assembly (12) and a centrifugal blower (14). The fin assembly includes a plurality of laminar fins (121) thermally connecting with the heat-generating electronic component to absorb heat therefrom. The centrifugal blower provides an airflow flowing through the fin assembly to take heat away therefrom. The centrifugal blower includes a housing (141), a cover (142) disposed on the housing, and a rotor (143) rotatably received in a space formed between the housing and the cover. The fins of the fin assembly are disposed in the housing of the centrifugal blower and stacked together along a direction substantially parallel to a rotation axis (A) of the rotor.

6 Claims, 3 Drawing Sheets

HEAT DISSIPATION APPARATUS

CROSS-REFERENCES TO RELATED APPLICATION

This application is related to the co-pending U.S. patent application Ser. No. 11/308,865, filed on May 16, 2006, and entitled "HEAT DISSIPATING APPARATUS", and filed with the same assignee as the instant application. The disclosure of the above-identified application is incorporated herein by reference.

FIELD OF THE INVENTION

The present invention relates generally to a heat dissipation apparatus, and more particularly to a heat dissipation apparatus for dissipating heat generated by electronic components, wherein the apparatus has a fin assembly including a plurality of fins stacked together along a direction parallel to a rotation axis of a centrifugal blower, for making an airflow generated by the centrifugal blower to flow more smoothly and evenly through the fin assembly.

DESCRIPTION OF RELATED ART

Following the increase in computer processing power that has been seen in recent years, greater emphasis is now being laid on increasing the efficiency and effectiveness of heat dissipation devices. Referring to FIG. 3, a heat dissipation apparatus 20 in accordance with related art includes a centrifugal blower 22 and a fin assembly 24 disposed at an air outlet 211 of the centrifugal blower 22. The fin assembly 24 includes a plurality of fins 242 which thermally connect with a heat generating electronic component (not shown) to absorb heat therefrom. The centrifugal blower 22 includes a casing 222, a stator (not shown) mounted in the casing 222, and a rotor 223 rotatably disposed around the stator. When the centrifugal blower 22 is activated, the rotor 223 rotates along a counterclockwise direction around the stator to drive an airflow to flow through the fin assembly 24 to take away heat therefrom.

In operation of the heat dissipation apparatus 20, the casing 222 guides the airflow to move toward the air outlet 211 of the centrifugal blower 22. A portion of the airflow leaves the centrifugal blower 22 at the upper side 246 of the air outlet 211 with another portion flowing toward a bottom side 244 of the fin assembly 24 from the upper side 246 thereof. A flow direction of the airflow flowing toward the upper side 246 of the fin assembly 24 is substantially parallel to the fins 242 thereof, while the airflow flowing toward the bottom side 244 of the fin assembly 24 forms an acute angle with each fin 242 at the bottom side 244 of the fin assembly 24. The airflow flowing toward the bottom side 244 of the fin assembly 24 may be deflected by the fins 242 thereof due to the acute angles formed therebetween. This deflection of the airflow may cause a loss in kinetic energy of the airflow. Thus, speed of the airflow flowing through the bottom side 244 of the fin assembly 24 may be reduced. The heat dissipation efficiency of the heat dissipation apparatus 20 will thereby be lowered. Accordingly, it can be seen that the heat dissipation efficiency of the heat dissipation apparatus 20 has room for improvement.

SUMMARY OF THE INVENTION

The present invention relates to a heat dissipation apparatus for dissipating heat from a heat-generating electronic component. According to a preferred embodiment of the present invention, the heat dissipation apparatus includes a fin assembly and a centrifugal blower. The fin assembly includes a plurality of laminar fins thermally connecting with the heat-generating electronic component to absorb heat therefrom. The centrifugal blower provides an airflow flowing through the fin assembly to take heat away therefrom. The centrifugal blower includes a housing, a cover disposed on the housing, and a rotor rotatably received in a space formed between the housing and the cover. The fins of the fin assembly are disposed in the housing of the centrifugal blower and stacked together along a direction substantially parallel to a rotation axis of the rotor.

Other advantages and novel features of the present invention will become more apparent from the following detailed description of preferred embodiment when taken in conjunction with the accompanying drawings, in which:

DETAILED DESCRIPTION OF THE INVENTION

Figure 1:
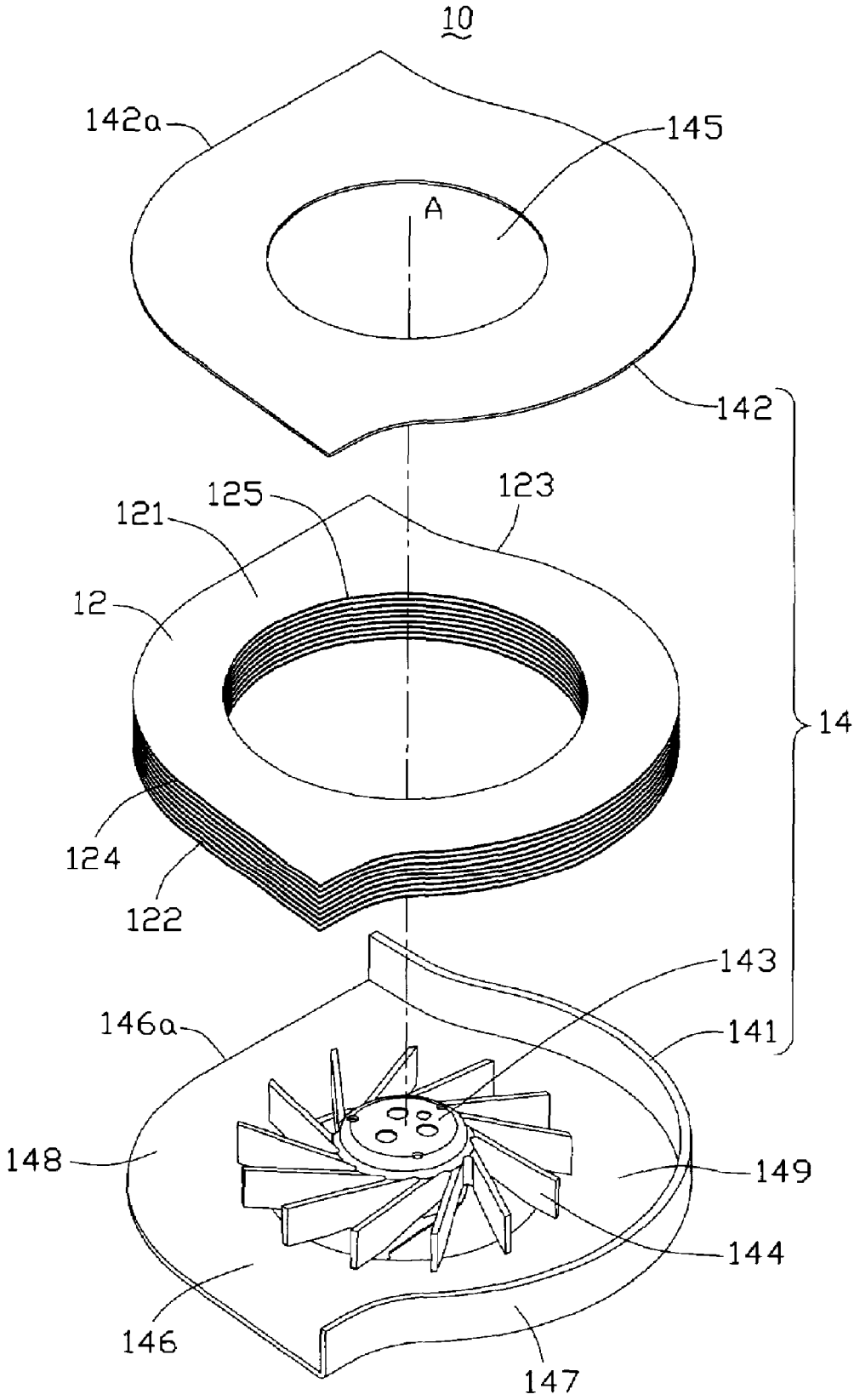
FIG. 1 is an exploded, isometric view of a heat dissipation apparatus according to a preferred embodiment of the present invention.
Figure 2:
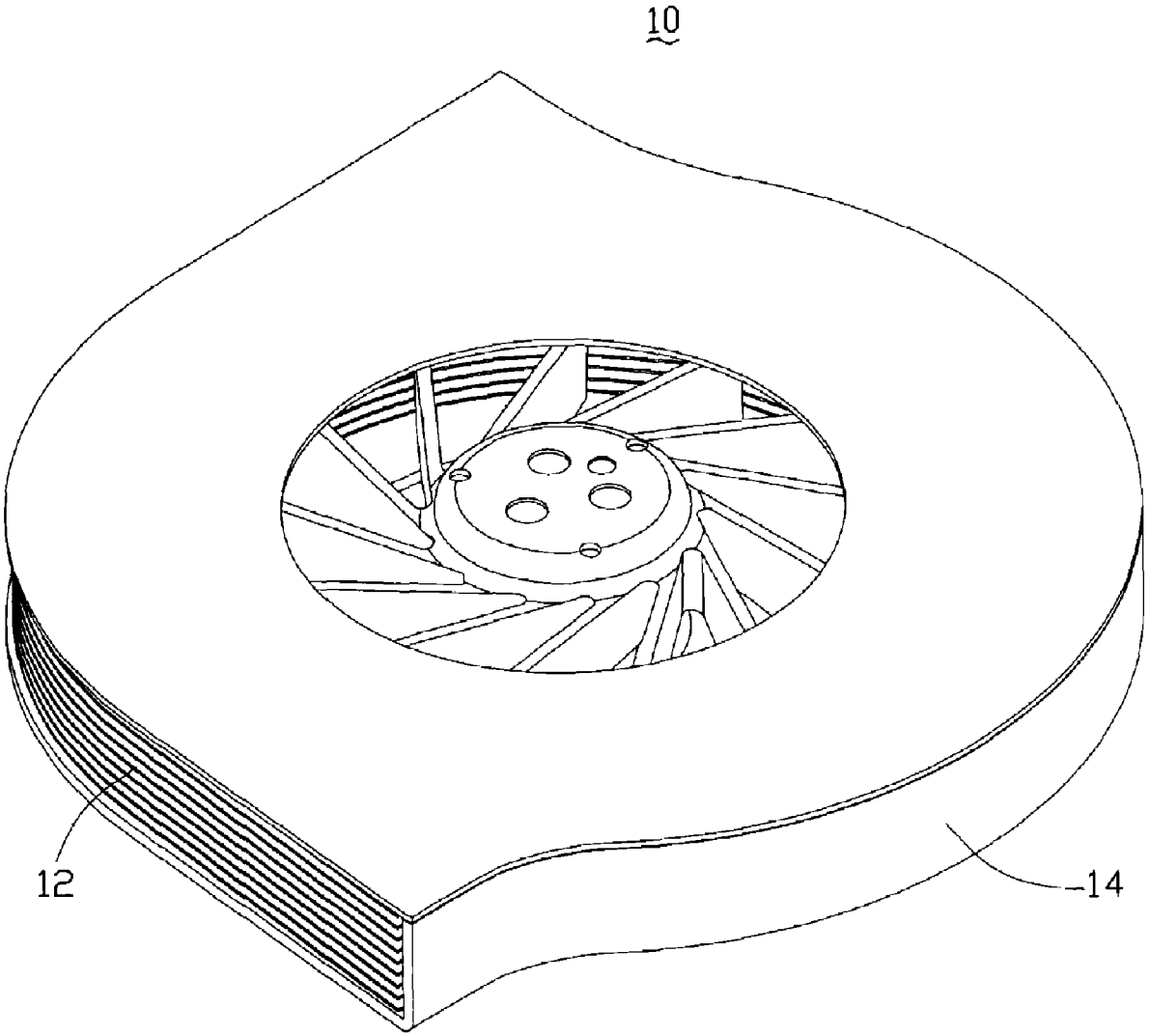
FIG. 2 is an assembled view of the heat dissipation apparatus of FIG. 1.
Figure 3:
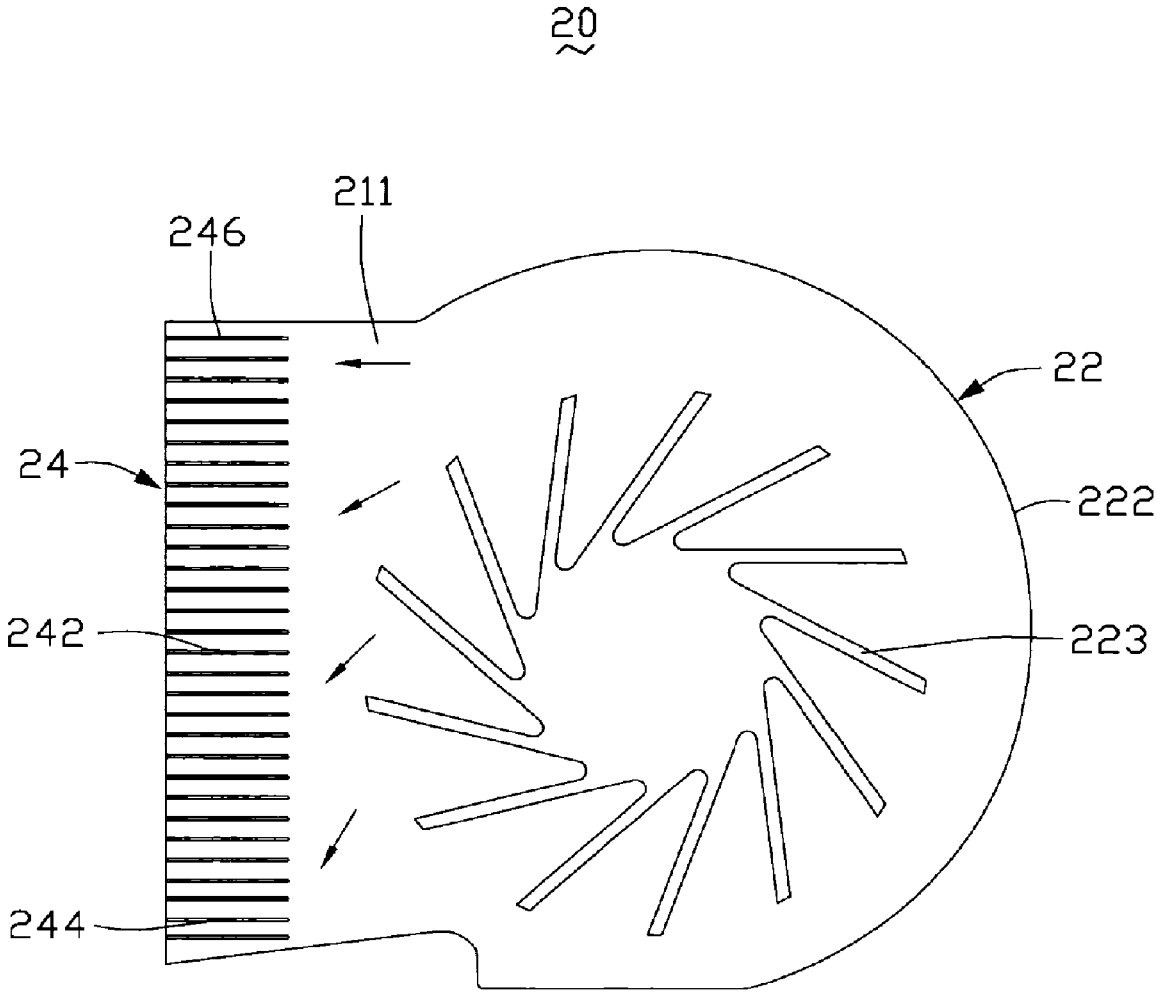
FIG. 3 (RELATED ART)
FIG. 3 is a top view of a heat dissipation apparatus in accordance with related art.

Referring to FIGS. 1 and 2, a heat dissipation apparatus 10 according to a preferred embodiment of the present invention is shown. The heat dissipation apparatus 10 includes a fin assembly 12 and a centrifugal blower 14. The fin assembly 12 includes a plurality of stacked laminar fins 121 thermally connected with a heat generating electronic component (not shown) to absorb heat therefrom. Although it is not shown in the drawings, it can be understood by those skilled in the art that the fins 121 of the fin assembly 12 can connect with the heat-generating electronic component via a plurality of heat pipes (not shown), each of which has an evaporator section contacting with the heat-generating electronic component, and a condenser section extending through the fins 121 of the fin assembly 12. The centrifugal blower 14 enables to provide airflow with a high air pressure so as to take away heat from the fin assembly 12.

The centrifugal blower 14 includes a housing 141, a cover 142 attached to the housing 141 with an inner space formed therebetween, a stator (not shown) accommodated in the inner space, and a rotor 143 including a plurality of blades 144 rotatably disposed around the stator. The cover 142 defines a through hole therein functioning as an air inlet 145 of the centrifugal blower 14. The housing 141 includes a flat bottom wall 146 perpendicular to a rotation axis A of the rotor 143, and an arc-shaped sidewall 147 perpendicular to the bottom wall 146. The sidewall 147 of the housing 141 defines an arcuate opening therein functioning as an air outlet 148 of the centrifugal blower 14. The cover 142 and the bottom wall 146 of the housing 141 respectively form an arcuate edge 142*a*, 146*a* at upper and bottom sides of the air outlet 148. An air channel 149 is formed between the blades 144 and an inner surface of the sidewall 147.

The fin assembly 12 is disposed surrounding the rotor 143, with a portion of the fin assembly 12 being in the air channel 149 of the centrifugal blower 14. The topmost fin 121 intimately contacts with a flat bottom surface of the cover 142 and the bottommost fin 121 contacts a top surface of the bottom wall 146 of the housing 141. The fins 121 are stacked along a direction parallel to the rotation axis A of the rotor 143. A plurality of laminar air passages 122 are formed between two adjacent fins 121 and perpendicular to the rotation axis A of the rotor 143. Each of the fins 121 includes an arc-shaped first outer edge 123 mated with the inner surface of the sidewall 147 of the housing 141, an arc-shaped second outer edge 124 matched with the air outlet 148 of the housing 141, and a round inner edge 125 disposed around the rotation axis A of the rotor 143. The inner edges 125 of the fins 121 are disposed adjacent to free ends of the blades 144 and surround the rotor 143. In the operation of the centrifugal blower 14, the airflow is divided into several smaller airflows, which evenly and smoothly arrive at the air passages 122 of the fins 121. The smaller airflows in the air passages 122 are driven towards the air outlet 148 of the centrifugal blower 14 via the rotation of the blades 144 to take away heat from the fins 121.

In the present invention, the laminar air passages 122 of the fin assembly 12 are perpendicular to the rotation axis A of the rotor 143. A flow direction of the airflow is substantially parallel to the air passages 122 of the fin assembly 12. The airflow is thereby evenly and smoothly flowing through the fin assembly 12, which prevents the kinetic energy loss of the airflow when flowing through the fin assembly 12. The heat dissipating efficiency of the heat dissipation apparatus 10 is therefore increased. The fins 121 are disposed in the inner space the housing 141, which increases contacting areas between the fins 121 and the airflow without increasing the size of the heat dissipation apparatus 10. The heat dissipating efficiency of the heat dissipation apparatus 10 is further increased. The fins 121 are disposed around the blades 144 of the centrifugal blower 14. The airflow is therefore directly arrived at the air passages 122 of the fins 121 and takes more heat from the fins 121. The heat dissipating efficiency of the heat dissipation apparatus 10 is thus further improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat dissipation apparatus comprising:

a centrifugal blower comprising a housing, a cover disposed on the housing, and a rotor rotatably disposed in a space formed between the housing and the cover; and a fin assembly comprising a plurality of fins each surrounding the rotor of the centrifugal blower;

wherein the housing comprises an arc-shaped sidewall, whilst each of the fins comprises an arc-shaped first outer edge mated with the arc-shaped sidewall of the housing; and wherein the housing comprises an arcuate air outlet, whilst each of the fins comprises an arcuate second outer edge matched with the air outlet of the housing.

2. The heat dissipation apparatus as described in claim 1, wherein each of the fins surrounds a rotational axis of the rotor of the centrifugal blower.

3. The heat dissipation apparatus as described in claim 2, wherein each of the fins comprises a round inner edge surrounding the rotational axis of the rotor.

4. The heat dissipation apparatus as described in claim 1, wherein the fins are stacked together along a direction non-perpendicular to a rotational axis of the rotor of the centrifugal blower.

5. The heat dissipation apparatus as described in claim 4, wherein the fins are stacked together along a direction parallel to the rotation axis of the rotor.

6. A heat dissipation apparatus comprising:

a housing having an air inlet and an air outlet oriented perpendicularly to that of the air inlet;

a rotor with blades thereon rotatably mounted in the housing, wherein when the rotor rotates, an airflow is formed by the blades to flow from the air inlet to the air outlet; and a fin assembly mounted in the housing and defining a hole receiving the rotor therein, the fin assembly having a plurality of fins horizontally stacked on each other wherein an air passage is defined between two neighboring upper and lower fins, the airflow flowing from the inlet to the outlet via the air passages;

wherein the air outlet is arc-shaped and each fin of the fin assembly has a first arc-shaped outer edge mating with the air outlet; and wherein the housing has an arc-shaped sidewall opposite the air outlet and each fin of the fin assembly has a second arc-shaped outer edge mating with the sidewall.

* * * * *